United States Patent [19]

Knudson et al.

[11] Patent Number: 4,846,963

[45] Date of Patent: Jul. 11, 1989

[54] IONIC LIQUEFACTION PROCESS

[76] Inventors: Curtis L. Knudson, 711 N. 25th St.; John R. Rindt, R.R. 2; Sylvia A. Farnum, 719 N. 25th St., all of Grand Forks, N. Dak. 58201

[21] Appl. No.: 853,703

[22] Filed: Apr. 18, 1986

[51] Int. Cl.[4] ..... C10G 1/00; C10G 1/06

[52] U.S. Cl. ..... 208/408; 208/415; 208/416; 208/419; 208/418; 208/430; 208/431

[58] Field of Search ..... 208/408, 415, 416, 419, 208/418, 430, 431

[56] References Cited

U.S. PATENT DOCUMENTS

| | | | |
|---|---|---|---|
| 3,642,607 | 2/1972 | Seitzer | 208/431 |
| 3,796,650 | 3/1974 | Urban | 208/419 X |
| 4,003,823 | 1/1977 | Baird et al. | 208/419 X |
| 4,018,572 | 4/1977 | Swanson | 208/430 X |
| 4,056,460 | 11/1977 | Molek | 208/418 |
| 4,085,031 | 4/1978 | Walchuk | 208/416 X |
| 4,157,246 | 6/1979 | Eakman et al. | 208/419 X |
| 4,247,384 | 1/1981 | Chen et al. | 208/430 |
| 4,266,083 | 5/1981 | Huang | 208/419 X |
| 4,292,048 | 9/1981 | Wesselhoft et al. | 208/419 X |
| 4,298,450 | 11/1981 | Ross et al. | 208/419 |
| 4,319,980 | 3/1982 | Jenkins | 208/415 |
| 4,338,184 | 7/1982 | Maa et al. | 208/219 X |
| 4,417,972 | 11/1983 | Frencie et al. | 208/419 |
| 4,439,304 | 3/1984 | Sudbury et al. | 208/419 |
| 4,451,351 | 5/1984 | Porter et al. | 208/415 |
| 4,566,965 | 1/1986 | Olmstead | 258/430 X |

*Primary Examiner*—H. M. S. Sneed
*Assistant Examiner*—William G. Wright
*Attorney, Agent, or Firm*—Shoemaker and Mattare, Ltd.

[57] ABSTRACT

A coal liquefaction process using ionic liquefaction techniques with polar solvent solubilizing agents and water soluble inorganic compounds, produces a carbonaceous liquefaction product which is separated from the process stream by the use of methanol as a partitioning agent and the methanol and solubilizing agent are recovered separately for reuse.

1 Claim, 3 Drawing Sheets

IONIC LIQUEFACTION PROCESS

Field of the Invention

This invention relates to the liquefaction of carbonaceous materials and in particular to a method of producing useful products, including products which can be used directly in petroleum-like refining processes, or as a feed stock for further chemical synthesis, or as a low sulfur fuel or the like, or at ambient temperatures can be a pseudo-plastic or particulate solid or semi-solid product having a melting point range of from about 100° C. to 200° C., or as a finely divided particulate can be burned in combustion engines, and are characterized by reduced sulfur and ash content.

BACKGROUND OF THE INVENTION

One of the principal approaches to coal liquefaction and solvation in the past has employed reactions producing free radicals through thermal bond rupture. For many kinds of coal used this typically required temperatures above about 350° C. for enough free radicals to form through thermal bond rupture of carbon-carbon bonds, carbon-oxygen bonds, carbon-nitrogen bonds and carbon-sulfur bonds, to react with other compounds or hydrogen in order to form lower molecular weight compounds than the complex materials present in the coal. In some typical prior processes the free radicals formed were stabilized and hydrogenated by hydrogen atoms through hydrogen transfer from solvent donor molecules such as 1,2,3,4-tetrahydronaphthalene or 9,10-dihydrophenanthrene, often used in the presence of minor amounts of coal solubilizing agents. After such reactions the solids are generally separated by distillation, or by solvent deashing. For such systems to be effective, it is important that the mixtures be suitable for either effective distillation or deashing without excessive coking. Another liquefaction process termed ionic liquefaction, described in U.S. Pat. No. 4,451,351, issued May 29, 1984, and application Ser. Nos. 471,731, filed March 3, 1983, now abandoned and 564,223, filed Dec. 27, 1983, now abandoned, the disclosures of which are incorporated herein by reference in their entity, utilizes a high proportion of highly polar solvents. In processes where even minor amounts of highly polar solvents are employed either in a liquefaction reactor or in subsequent processing, distillation problems are encountered and when alkali compounds are present, severe coking problems can arise.

BRIEF SUMMARY OF THE INVENTION

The present invention uses methanol to precipitate solid products from liquefaction processes that utilize a mixture of carbonaceous material, polar solvent, and alkaline compounds, in order to produce a particulate solid product. The resulting solid products are then separated and the polar solvent recovered in various process embodiments described hereinafter.

The use of a methanol-water precipitation in ionic liquefaction processes minimizes many of the deleterious effects normally encountered in the distillation, separation, and stabilization of mixtures containing polar organic liquids and alkaline compounds. It is therefore an achievement of this invention to provide for the improved separation of solid products from liquefied carbonaceous materials. The invention as described also provides an integrated process for the liquefaction of carbonaceous material separation of solid products derived therefrom, starting from the preparation of the feed material to the separation of solid particulate products, including the recovery and use of recycle streams rich in phenolic solubilizing agents. The solid or pseudo-plastic material that is recovered is a finely divided solid at room temperature, which has reduced sulfur and ash content and which is useful as a fuel, coke or petrochemical feedstock.

DETAILED DESCRIPTION OF THE INVENTION

As used herein, the terms carbonaceous material, includes solid, semi-solid and liquid organic materials which are susceptible to the described treatment methods. Examples of solid carbonaceous materials which may be used in connection with the practice of the present invention include coal, such as anthracite, bituminous, subbituminous and lignite coals, as well as other solid carbonaceous materials, such as wood, lignin, peat, solid petroleum residuals, solid carbonaceous materials derived from coal, and the like. Examples of semi-solid and liquid carbonaceous materials include coal tars, tar sand, asphalt, shale oil, heavy petroleum oils, light petroleum oils, petroleum residuals, coal derived liquids and the like.

Ionic liquefaction as used herein is intended to mean the chemical process described in previously described ionic liquefaction processes which are characterized by the use of polar solvent solubilization of the polymeric structure of carbonaceous materials susceptible to the described treatment methods, in the presence of alkali and alkaline earth compounds in amounts which favor ionic reactions involving the solubilized carbonaceous material and ionic species such as phenoxide, hydroxide, and formate ions, and favor stabilization of the ionic species to produce distillable products, low-sulfur products, and low-ash reduced-sulfur pseudo-plastic, normally solid products useful as fuel, coke, or petrochemical feedstocks.

In addition to ionic reactions, it is believed that ionic liquefaction, as described, may change the apparent molecular weight and other physical properties of the solubilized carbonaceous material by reducing the extent of hydrogen bonding between the molecules present in carbonaceous materials. Because of the reactive nature of ionic species remaining after solubilization and ionic reaction, the resultant product mixture after liquefaction must be further processed in order to remove gases, to remove insoluble solid impurities, and to precipitate solid product and stabilize the reaction products and reactants to be able to recover usable products including a recycle stream rich in phenolics which can again be used in the ionic liquefaction reactions. This processing includes using a methanol-water mixture to solubilize the light phenolics and sodium ions into a distinct phase which can be separated from insoluble phases, and subsequently distilled liquefaction to recover the recyclable phenolic solvents.

The amount of methanol required is dependent on the water content of the solution to be extracted. Likewise, the amount of water present in the solution is dependent on the nature of the gas/liquid phase separation and the water in the reaction mixture.

Figure 3:
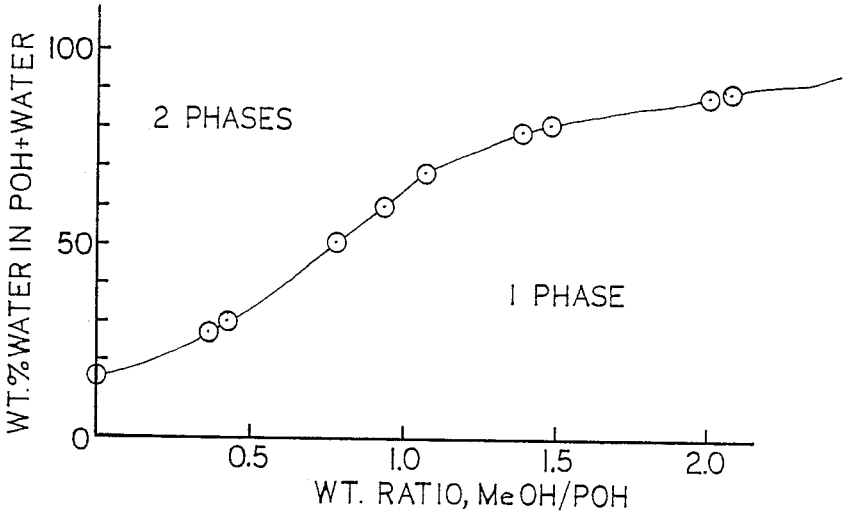
FIG. 3 is a graph showing the effect of water on the formation of two phases from a phenolic/methanol mixture.
Figure 4:
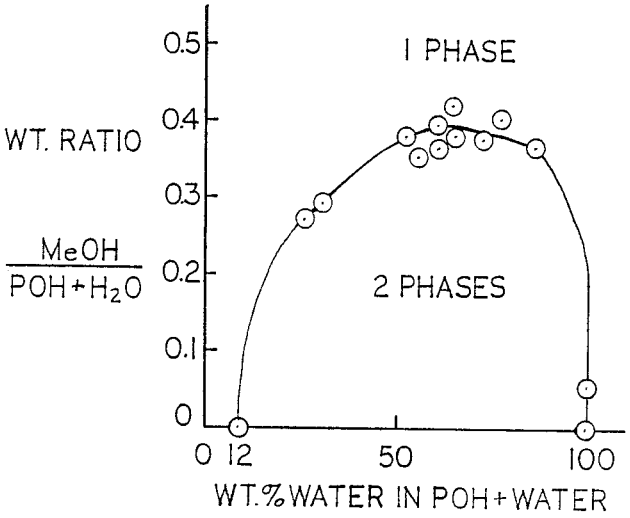
FIG. 4 is a graph showing the effect of water in ratios of methanol and phenolics in the formation of two phases.

The relationships necessary for the formation of a single phase of methanol and light phenolics are shown in FIGS. 3 and 4. In view of these relationships it can be determined whether it is necessary or desirable to adjust, in a predetermined manner the amounts of water and/or methanol that are required, in a given system, to produce the formation of a single phase. The remaining process steps are further described hereinafter.

The term alkaline as used herein is synonymous with basic which includes, without limitation, alkali metal and alkaline earth compounds. A base can be an aqueous solution which contains $OH^-$ ions, or any substance which accepts protons, or any substance which is an electron pair donor. Typical cations are the light metals of groups IA and IIA. Preferred cations are $Na^+$ and $K^+$. Typical anions include $OH^-$, $CO_3^=$, $HCO_2^-$, and $HCO_3^-$.

As applied to ionic liquefaction a polar solvent or polar solvents means a solubilizing agent selected from the group consisting of aromatic alcohols, phenols, polycyclic phenols and substituted phenols, and mixtures thereof. Typically, such solvents do not have an $\alpha$-hydrogen. Liquid mixtures of solubilizing polar solvents used in the ionic liquefaction process of the present invention typically will contain greater than 50% by weight of such polar solvents.

Synthesis gas, as that term is used herein, means a gas primarily comprised of carbon monoxide and hydrogen. Other gaseous components present in small concentrations can include carbon dioxide, light hydrocarbon gases, and some impurities such as nitrogen and still be effective in the process described herein. In addition, small amounts of water vapor may also be present.

The higher yields of products achieved in the present invention through the synergistic effect in a liquefaction reactor of a solvent/solute system combining a phenolic solvent, water and added amounts of an alkali or alkaline-earth metal compound, and the use of methanol in recovery with or without the addition of synthesis gas, depending on the reactants selected will be more fully described hereinafter.

In summary, the prior ionic liquefaction process for coal or other carbonaceous material can be substantially improved by the use of an organic solvent containing greater than 50% by weight of phenolic compounds in amounts between about 1.5 to 3.5 times the weight of carbonaceous materials, in combination with between about 25 to about 400 parts by weight of alkali for every 1000 parts by weight of carbonaceous material, and beween about 25 to about 400 parts by weight of water for every 1000 parts by weight of carbonaceous material; when the carbonaceous material, the organic solvent and the solvent/solute pair are reacted together at temperatures less than about 360° C. and pressures between about 100 to about 2500 psig. Further improvement can be obtained by the presence of synthesis gas, having a $H_2/CO$ ratio between about 0.5 and 2.0 in amounts between about 0.16 to about 1.25 $m^3/Kg$ of carbonaceous material in the reaction step when combined with gas and solid separations prior to the formation of distinct phases using methanol recovery of the solid phase and followed by recovery of methanol and recycle of a high phenolic stream containing alkali and water.

In order to promote the solvent regeneration reaction, the extraction with methanol of light phenolics can reduce the problems associated with distillation, and subsequent treatment, to recover recycle solvent. During distillation, the conditions can be adjusted so that the methanol is recovered.

The ionic liquefaction described herein, at the conditions employed, will produce methanol extractable polar solvent recycle streams having desirable low molecular weights.

The presence of highly polar phenolic compounds, alkali compounds, and the ionic forms thereof, along with the oxygenated compounds derived from the carbonaceous material, during the ionic liquefaction processes, can, as described, lead to potential processing problems downstream from the liquefaction reactor. Some oxygenated compounds, including many phenols, are often thermally unstable, especially in the presence of coking promoters such as ionic alkaline species. These compounds are concentrated in the bottoms during distillation operations. It is, therefore, important to either minimize the amount of alkaline compounds present in the distillate feed stream and/or reduce the severity of distillation conditions to minimize coking. Typically, the prior solutions required that a major proportion of the alkaline compounds were removed before distillation is begun because of the severity of the conditions required for recycle solvent recovery. Regardless, it has been shown that a portion of the phenolic becomes adducted during distillation which adversely effects the quality of the recycle solvent. The present invention eliminates these prior problems.

Under the conditions typically used in ionic liquefaction, i.e., relatively low temperature and low pressure, quantities of coal-derived phenolics are produced, but because of adduction, the amount of phenolics recovered is limited. Therefore, to regenerate solvent and obtain additional product, a portion of the liquefaction product liquids should preferably undergo further reaction in the presence of hydrogen under conditions which will break the bond between the phenolic and the coal derived organic species. The reaction may be performed at conditions which are severe enough to break the bond, but are not severe enough to saturate the aromatic ring, or remove the oxygen atom as water. The use of methanol described herein helps to recover the light phenolics prior to adduction in a manner to make the subsequent solvent recovery and stabilization more efficient.

Because the ionic liquefaction products produced by the liquefaction processes described are typically high in reactive oxygenated species there can be a tendency for the products to oxidize and polymerize with time or with severe thermal treatment. In the case where additional solvent recovery and product upgrading are necessary, specific sequential processing steps are then needed. A process incorporating these necessary steps is shown in FIG. 1, which is modified according to the present invention as further described herein (FIG. 2).

Figure 1:
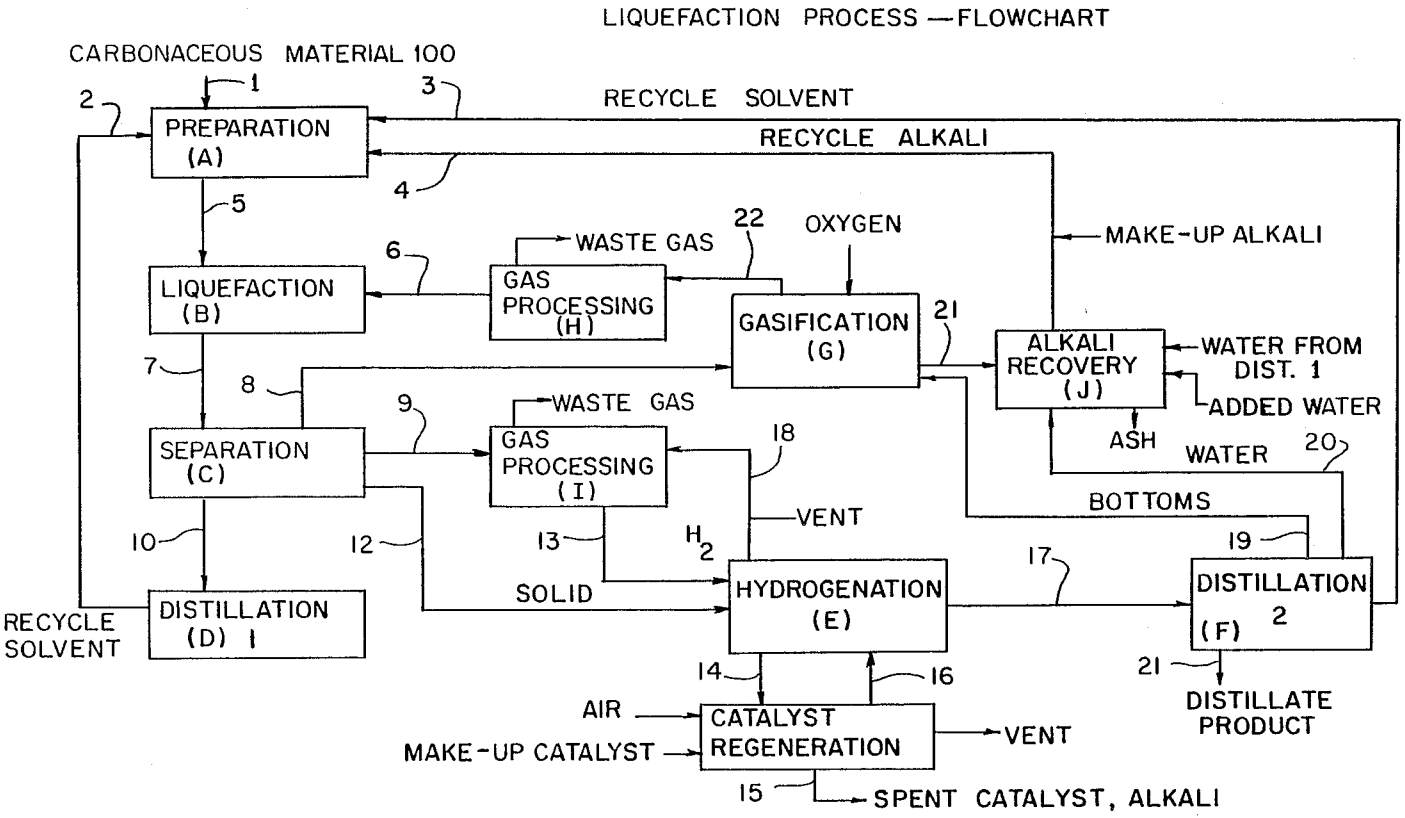
FIG. 1 is a schematic flow chart of a typical integrated ionic liquefaction process.
Figure 2:
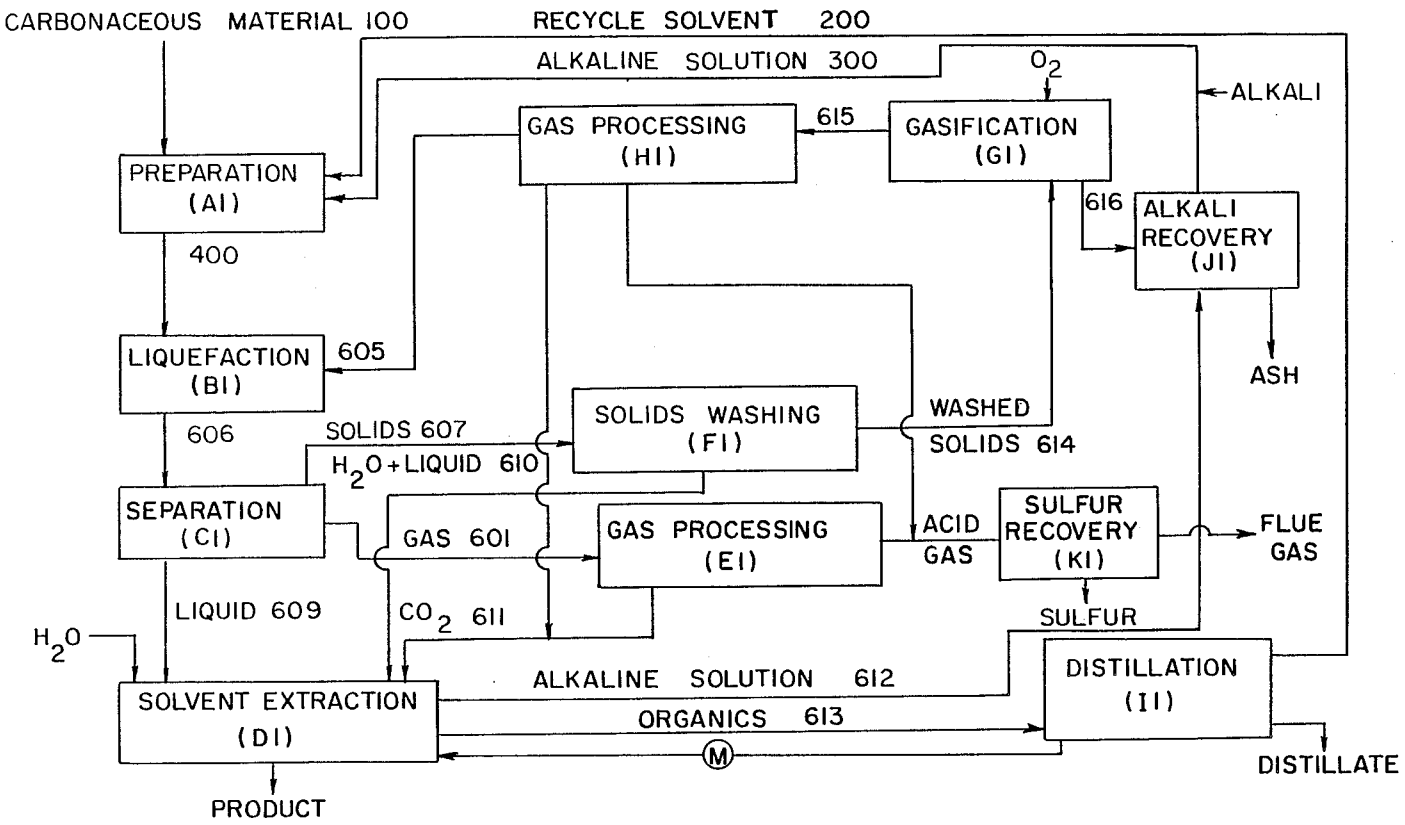
FIG. 2 is a schematic flow chart of integrated ionic liquefaction process useful for the production of a fuel and coke substitute, using a methanol and water partitioning process step.

Referring to the schematic diagrams in FIGS. 1 and 2, the feed preparation at (A1), comminutes the carbonaceous material, stream (1) (100), by conventional means such as hammermills or ball mills or comparable equipment; and adds a water-alkali mixture stream (4) (400); and recycle polar solvent streams (2) and (3) (200), containing greater than 50% by weight of phenolic species. The comminution process may be accomplished either dry or wet. If performed wet, then the recycle polar solvent may be used as the wetting agent, if proper precautions are taken. The carbonaceous feed is preferably comminuted to 100 percent minus 74 micron (200 mesh) particle size, more preferably to 100 percent minus 147 microns (100 mesh) particle size, and most preferably to 100 percent minus 350 microns (40 mesh) particle size but in any event must be in a form which will enable the requisite solubilization for the ionic liquefaction to proceed.

Using 1000 parts by weight of streams (1) to (100) carbonaceous material as an example, the preferred amount of polar recycle solvent for the required solubilization to proceed, streams (2) plus (3) is between 1500 and 3500 parts by weight depending on the prepared form of the carbonaceous material, with 2000 parts by weight of solvent the most preferred amount. The polar recycle solvent contains preferably greater than about 50% by weight of phenolic compounds, and more preferably greater than 60% by weight phenolic compounds.

The preferred amount of alkaline material in streams (4) (400) is selected to be enough to produce the desired results. It has been found under the conditions disclosed herein that between about 25 parts and 400 parts by weight per 1000 parts by weight of carbonaceous material is effective with the more preferred amount being between about 25 and 150 parts by weight, and depending on the kinds and amounts of phenolic compounds employed, the preparation of the carbonaceous material and the conditions selected, the most preferred amount is about 50 parts. The amount of water in stream (4) should preferably be sufficient to maintain the alkaline material in the ionic form in solution at the herein described ionic liquefaction conditions, and sufficient to allow the water gas shift reaction to occur during liquefaction in order to produce the hydrogen required for solvent regeneration and ionic species stabilization in the hydrogenation (E) step. The amount of water in stream (4) is between about 25 and 400 parts by weight, more preferably between about 50 and 250 parts by weight, and most preferably between about 100 and 200 parts by weight.

The reaction products exiting the reactor (B) (B1), stream (7) 606 of FIGS. 1 and 2, are then separated into component streams in the separation system, process step (C) of FIG. 1 and (C1) of FIG. 2.

Leaf filters, candle filters, hydroclones, or comparable equipment can be used for the filtration. Solids may also be separated by processes such as solvent deashing, or critical solvent extraction. The purpose of the filtration step is to separate unreacted carbonaceous material and insoluble alkaline salts from the ionic liquefaction product liquids. Due to the hygroscopic nature of the alkaline salts, much of the water present will also be separated with the filter cake.

The preferred temperature for filtration is preferably between about 150° and 100° C. (302° and 212° F.). The pressure is maintained at a sufficient level to obtain efficient filtration, preferably between about 0.34 and 1.03 MPa (50 psia to 150 psia). In the filtration step, the solids content of the liquid is typically reduced to less than about 1.0 percent by weight, the mineral matter content to less than about 0.5 percent by weight, and the alkaline species content to less than about 0.25 percent by weight. The values obtained are dependent upon factors such as the degree of comminution used in feed preparation, the ionic liquefaction conditions selected, and the design of the filter equipment design.

The separation step of the present invention (FIG. 2) should preferably be operated to reduce the water content of the filtrate stream (liquid 609) of FIG. 2, below about 20 percent by weight, more preferably below about 15 percent by weight, and most preferably below about 10 percent by weight. Water concentrations above this level in the embodiment of the present invention shown in FIG. 2, are not desirable since that can lead to increased methanol use and the undesirable potential for forming two phases, as well as creating additional distillation requirements in downstream processing steps.

In the prior processes, stream (10) of FIG. 1, with alkaline compound contents of about 0.25 percent by weight and phenolic content greater than about 50 percent by weight may successfully be further processed by distillation (D), although the upper limit is dependent upon the exact nature of the product. The solids rich filter cake, and stream (8) of FIG. 1, are used as feed to a gasification system (G) for production of synthesis gas and recovery of alkaline compounds (J). The gas stream, stream (9) of FIG. 1, is sent to gas processing (I) for upgrading before use as hydrogen rich gas in subsequent hydrogenation (E) operations.

The liquids from the separation system organics 613 of FIG. 2 are sent, to a distillation tower in the same manner as stream (10) of FIG. 1, where the methanol containing recycle stream is fractionally distilled. The products from the distillation are methanol, stream (M) of FIG. 2, and a recycle solvent stream, stream (200) of FIG. 2.

The distillation operation has two primary purposes. First, methanol is recovered for recycle. Second, a polar recycle solvent stream containing greater than about 50 weight percent phenolic materials is recovered.

After the solvation of the carbonaceous material in an ionic liquefaction reactor) the slurry is removed and the temperature and pressure reduced. The slurry is filtered to remove the ash and undissolved organic material that has not dissolved in the solvent/solute system. A large portion of the ash will be removed in this step including a majority of the inorganic sulfur. The filtrate in the embodiment of FIG. 2 was then transferred to a liquid extraction stream to remove dissolved ash components and alkali. The ash and alkali are removed by contacting the filtrate with an methanol and water, or the like.

The present invention eliminates the liquid-liquid extraction step previously utilized in ionic liquefaction.

The use of a methanol water mixture precipitates particulate solid product from the de-gassed/de-ashed liquefaction reactor product stream.

The extracted solvent and methanol treated filtrate is then distilled to recover the solvent. The overheads from the distillation tower contain methanol and a lower cut provides improved recovery of recycle solvent. The distillation temperature is selected to accomplish this result.

In summary, the use of a methanol-water precipitation process step in ionic liquefaction process trains can provide an improved particulate solid product and improved phenolic recycle solvent recovery. The separation of particulate solids is then accomplished by the use of sufficient methanol added to the filtered product stream to precipitate the solid product desired.

The forgoing may be further understood in connection with the following examples.

Coal obtained from the Indian Head Mine of North Dakota was ground to a tap size of 100 mesh. The coal was mixed 1 part coal to 2 parts process derived recycle solvent which contained greater than 50% phenolics and the alkali and water content adjusted to about 15% added water and 17% added sodium hydroxide. The slurry was pumped through a preheater, reactor and pressure let down continuous flow system in the presence of carbon monoxide. The de-gassed reactor product was de-ashed in a continuous basket centrifuge and samples A and B collected.

Sample B contained coal derived liquid products was treated with formic acid. The aqueous phase containing water, alkali, and residual phenolics was removed. The organic phase containing recycle solvent and coal derived products was collected and distilled. The non-distillable fraction was collected and analyzed.

Sample A containing as above, was contacted with an equal volume of methanol. An insoluble phase was recovered and analyzed as A above.

Thermogravimetric analysis and $^{13}C$ and NMR was performed on samples A and B above. Sample B contained an average of 15.8 weight percent phenolics of which 12.0 weight percent was tightly bound and could not be removed by heat treatment. Sample A contained an average 1.1 weight percent which would not be recovered by heat.

Further the non-distillable pseudo-plastic solid from sample B was collected as a residual mass from the distillation. Sample A was produced as a precipitated material and collected by filtration. The particle size of sample A was 100 percent minus 200 mesh.

The foregoing description of improved recovery of liquefaction products and recycle solvents, achieved by the use of a methanol precipitation is useful in other, similar processes, and the scope of the claimed invention is to be limited only by the prior art, as applied to the appended claims.

What is claimed is:

1. A method of regenerating the solubilizing agent from the process stream of a single stage ionic coal liquefaction process wherein said coal liquefaction is accomplished by reaction of the coal with a polar solvent solubilizing agent and an aqueous solution containing inorganic ionic species where major amounts of the solubilizing agent are selected from the group consisting of aromatic alcohols, phenols, polycyclic phenols and substituted phenols; including o-cresol, m-cresol, p-cresol, catechol, resorcinol, naphthol and mixtures and derivatives thereof; and minor amounts of polycyclic aromatic hydrocarbons, partially-hydrogenated polycyclic aromatic hydrocarbons and fully hydrogenated polycyclic aromatic hydrocarbons having from 1 to 4 carbon rings such as naphthalene, anthracene, phenanthrene, acenaphthalene, 1-methylnaphthalene, 2-methylnaphthalene, tetralin, gamma-picoline, isoquinoline, dihydronaphthalene, decalin, 9,10-dihydroanthracene, 9,10-dihydrophenanthrene and mixtures and derivatives thereof, as well as carbonaceous material-derived solvents; and (b) the inorganic ionic species are dissolved in water and include a compound having a cation selected from the group consisting of alkali and alkaline-earth metals comprising the steps after ionic liquefaction of:

(1) removing non-condensible gases from said process stream;
(2) removing immiscible water from said process stream;
(3) removing alkaline compound containing solids from said process stream;
(4) removing carbonaceous products from said process stream by the use of methanol;
(5) separating methanol from the solubilizing agent;
(6) separately hydrotreating said carbonaceous products;
(7) recovering methanol; and
(8) recovering regenerated solubilizing agent capable of being used directly in a single stage ionic coal liquefaction process.

* * * * *